United States Patent [19]

Calandra, Jr.

[11] Patent Number: 4,678,374

[45] Date of Patent: Jul. 7, 1987

[54] ROOF BOLT WITH EXPANSION SHELL AND THREADED NUT

[75] Inventor: Frank Calandra, Jr., Pittsburgh, Pa.

[73] Assignee: Jennmar Corporation, Pittsburgh, Pa.

[21] Appl. No.: 908,338

[22] Filed: Sep. 17, 1986

Related U.S. Application Data

[63] Continuation of Ser. No. 808,874, Dec. 13, 1985, abandoned, which is a continuation of Ser. No. 644,347, Aug. 27, 1984, abandoned.

[51] Int. Cl.[4] ..... E21D 20/02

[52] U.S. Cl. ..... 405/261; 411/2; 411/39

[58] Field of Search ..... 405/259–262; 411/2–5, 39–43, 55, 57, 60, 82

[56] References Cited

U.S. PATENT DOCUMENTS

| | | | |
|---|---|---|---|
| 3,877,235 | 4/1975 | Hill | 405/261 |
| 4,100,748 | 7/1978 | Hansen | 405/259 |
| 4,295,761 | 10/1981 | Hansen | 405/261 |
| 4,347,020 | 8/1982 | White et al. | 405/260 |
| 4,516,886 | 5/1985 | Wright | 405/261 |

*Primary Examiner*—David H. Corbin

*Attorney, Agent, or Firm*—Stanley J. Price, Jr.

[57] ABSTRACT

An elongated rod with an expansion shell assembly positioned on the upper end portion thereof is advanced behind a resin cartridge system into a bore hole drilled in a rock formation. A bearing plate and a stop nut are positioned on the end of the rod emerging from the bore hole. Unitary rotation of the nut and rod in a preselected direction while maintaining the shell assembly in an unexpanded condition effects mixing of the resin components. Continued rotation of the nut and rod after the resin components are mixed effects expansion of the shell into engagement with the wall of the bore hole to anchor the rod in the bore hole. The rotation applied to the nut after setting of the shell permits the nut to advance on the lower end of the rod to urge the bearing plate into compressive relation with the rock formation to put the rod under tension without interrupting rotation to allow the mixed resin to cure.

10 Claims, 6 Drawing Figures

ROOF BOLT WITH EXPANSION SHELL AND THREADED NUT

CROSS REFERENCE TO RELATED APPLICATIONS

This application is a continuation of copending application Ser. No. 808,874 filed on Dec. 13, 1985, entitled "Roof Bolt With Expansion Shell And Threaded Nut", now abandoned, which inturn is a continuation of application Ser. No. 644,347 filed on Aug. 27, 1984 and now abandoned.

BACKGROUND OF THE INVENTION

1. Field of the Invention

This invention relates to a method and apparatus for combining resin bonding and mechanical anchoring of a roof bolt in a bore hole of a rock formation and more particularly to a mine roof support system that includes the features of both a point anchor resin roof bolt and a mechanical anchor roof bolt.

2. Description of the Prior Art

It is well known to reinforce and stabilize underground ock formations, such as a coal mine roof, a subway tunnel or similar subterranean strcutre or to strengthen a rock mass by the use of anchor bolts inserted within a bore hole drilled in the rock formation. The anchor bolts are tensioned during installation to reinforce the unsupported rock formation above the roof, for example, above the roof of a mine passageway. Conventionally, a hole is drilled through the roof into the rock formation. The end of the bolt in the rock formation is anchored either by engagement of a mechanical expansion shell with the wallof the rock formation around the bore hole or chemically anchoring the bolt by a multicomponent resin system or grout to the rock formation surrounding the bore hole. With a chemical anchor, after the resin or grout is mixed by rotation of the bolt, the material penetrates into the surrounding rock formation to adhesively unite the rock strata and anchor, by bonding, the bolt to the rock formation surrounding the bore hole. The mixed resin or grout fills the annulus between the bore hole wall and the bolt along a substantial length of the bolt.

U.S. Pat. Nos. 3,108,443; 3,892,101; 3,940,941; 3,974,918; 4,051,683; 4,127,000; 4,129,007; 4,263,832; and 4,303,354 are examples of systems that use a grout or resin to anchor a roof bolt in a rock formation. U.S. Pat. Nos. 3,925,996 and 4,216,180 disclose a multicomponent system for chemically anchoring a roof bolt in a rock formation. These resin systems are quick-setting whereby, once the components are mixed, the mixture cures and begins to harden within seconds after mixing.

In a multicomponent resin system, the components are separated until the time that mixing and setting is desired. The components are maintained separated in compartments of a fragmentable cartridge. The cartridge is inserted into the bore hole in the roof and the roof bolt is pushed into the bore hole to advance the cartridge to the closed end of the bore hole where the cartridge is ruptured and the chemical components are mixed upon continued rotation of the bolt.

It has been the conventional practice to rotate the bolt for a period of time to thoroughly mix the components in order to insure a complete cure of the chemical mixture. Thereafter, once the chemical mixture cures and hardens, the bolt is bonded to the wall of the rock formation in the bore hole. It is disclosed in U.S. Pat. No. 4,216,180 that once the resin cartridge is ruptured, components are mixed and the mixture cures without requiring rotation of the bolt.

A roof bolt which is mechanically anchored in a bore hole, is placed in tension once the upper end of the bolt is anchored in the bore hole by compression of a roof plate into contact with the face of the rock formation surrounding the opening into the bore hole. Tensioning an anchored mine roof bolt compresses the rock strata to reinforce the strata to resist shifting of the strata above a mine passage or an underground tunnel.

U.S. Pat. Nos. 3,940,941; 3,979,918; 4,303,354; and 4,386,877 disclose point anchor resin roof bolt support systems in which the roof bolt is chemically bonded to the rock formation and is placed in tension after the mixed resin is allowed to harden. A multicomponent resin cartridge system or grout is advanced by the upper end of the roof bolt into the bore hole. The bolt and the cartridge system are advanced into the bore hole to a position where the threaded end of the bolt emerges from the bore hole. A roof plate positioned on the emerging end of the bolt abuts against the face of the rock formation around the bore hole. A nut is placed on the threaded end of the bolt below the roof plate.

The bolt is rotated to effect mixing of the components of the resin system or grout. After a short period of time, for example, 5 seconds in the case of a quick-setting resin, rotation is stopped to permit curing of the mixed resin components for a preselected period of time, for example, 30 to 60 seconds. After the resin is cured and has hardened sufficiently, the nut is rotated on the emerging end of the bolt but the bolt does not rotate due to the resistance to rotation presented by the cured resin surrounding the bolt. The nut is tightened against the roof plate to put the roof plate under the desired tension.

In one method of operation, the roof bolt and the nut are rotated in one direction to effect mixing of the resin components. After the components are mixed and allowed to harden, during which time the bolt is not rotated, the nut is rotated in an opposite direction on the bolt to place the bolt in tension. In another method of operation, the direction of rotation for mixing the resin components is in the same direction of rotation of the nut on the bolt to tension the bolt. In both of these cases, the nut is provided with a stop or shearable means for resisting relative rotation between the nut and the bolt until the cured resin offers sufficient resistance to rotation of the bolt and continued rotation of the nut advances the nut on the bolt.

U.S. Pat. Nos. 3,877,235; 4,023,373; 4,051,683; and 4,275,975 disclose a chemically anchored roof bolt system that includes an anchor portion which is inserted into the bore hole behind a resin cartridge and a lower portion connected to the anchor portion. In U.S. Pat. No. 4,023,373, the anchor portion is a pipe-like, hollow, cylindrical member into which extends the threaded end of a bolt. In U.S. Pat. No. 4,051,683, the anchor member is a rebar connected by a coupling to a bolt which supports the roof plate. With these devices, once the resin components have been mixed and the mixture cured and sufficiently hardened to adhesively secure the anchor portion in the bore hole, application of a predetermined amount of torque to the bolt below the anchor releases the bolt for rotation relative to the anchor to draw the roof plate into compressive relation withthe mine roof and thereby put the bolt under tension. The anchor portion is not tensioned, only the bolt is tensioned. These systems do not utilize an expansion shell to anchor the roof bolt in the bore hole.

U.S. Pat. Nos. 4,413,930 and 4,419,805 disclose method and apparatus for combining resin bonding and mechanical anchoring of a bolt in a rock formation. With these devices, a single bolt with a mechanical anchor threaded onto the upper end of the bolt is inserted into the bore hole behind the resin cartridge. A roof plate is carried on the opposite end of the bolt for abutment against the rock formation surrounding the open end of the bore hole. The cartridge is ruptured by the upward thrust and rotation of the bolt to release the resin components for mixing. A stop device associated with the expansion shell restrains expansion of the shell during rotation of the bolt in a preselected direction to mix the resin components. Rotation of the bolt continues without expansion of the shell for a predetermined period of time to permit the mixed resin to cure. As the resin mixture begins to harden and the bolt encounters resistance to rotation, the stop device is released to permit expansion of the shell into engagement with the wall of the bore hole before the mixed resin completely hardens. With this arrangement, the bolt is continuously rotated from the initial insertion to the point where the preselected torque has been applied to the bolt to put the bolt under the desired tension. thus,the bolt is both mechanically and chemically anchored in the bore hole.

While it has been suggested by the prior art point anchor resin roof bolt devices to chemically anchor a roof bolt in a rock formation and also put the bolt under tension, the prior art devices require complete mixing and curing of the resing before the bolt is finally installed under tension. This required that the bolt be initially rotated to mix the resin components and rotation interrupted for a period of time to permit the resin mixture to cure. Thereafter, the bolt or a nut on the bolt is rotated in a preselected direction to put the bolt under a desired degree of tension. Even though the development of quick-setting resins has shortened the hold time before the bolt can be fully tensioned, interruption of the bolt rotation is still required. Therefore, there is need, in the chemical anchoring of a roof bolt in rock formation, for a system that permits continuous uninterrupted rotation of the bolt once it is inserted in the bore hole to the point of final tensioning where the resin components or grout are mixed and cured without interrupting the initial rotation of the bolt to put the bolt under tension.

SUMMARY OF THE INVENTION

In accordance with the present invention, there is provided apparatus for supporting a rock formation that includes an elongated rod positioned in a bore hole of a rock formation. The rod has a first threaded end portion and a second threaded end portion. The rod first threaded end portion is positioned adjacent the end of the bore hole. The rod second threaded end portion extends out of the bore hole. A camming plug is threadedly engaged to the rod first threaded end portion for axial movement thereon. An expandable shell has a plurality of longitudinally entending fingers spaced one from another. The fingers each have an inner surface and an outer surface. A portion of the inner surface abuts the camming plug and the outer surface is adapted to engage the wall of the bore hole. Means associated with the camming plug prevents axial movement of the camming plug on the bolt upon rotation of the bolt in a preselected direction. A bearing plate is positioned on the rod second threaded end portion. A nut engages the rod second threaded end portion below the bearing plate. Stop means is positioned in the nut for obstructing axial movement of the nut beyond a first position on the rod second threaded end portion to permit rotation in said preselected direction of the nut and the rod as a unit. The means associated with the camming plug is displaced upon continued rotation in said preselected direction of the nut and the rod. The camming plug is movable upon displacement of the means associated with the camming plug to expand the fingers to anchor the rod in a fixed position in the bore hole. The stop means is displaced from a position in the nut obstructing axial movement of the nut on the rod second threaded end portion when a predetermined torque is exceeded upon continued rotation of the nut in said preselected direction. the nut is rotatable relative to the rod upon displacement of said stop means to advance to a second position on the rod second threaded end portion to urge the bearing plate into engagement with the rock formation and put the rod under tension on the bolt.

Further in accordance with the present invention there is provided a combination mechanical anchor and chemical anchor system for supporting a rock formation that includes a chemical anchor material positioned in an unmixed condition in a bore hole of a rock formation. An elongated rod is positioned in the bore hole. The rod has one end portion positioned adjacent the chemical anchor material and an opposite threaded end portion extending out of the bore hole. Means is provided for mechanically anchoring the rod one end portion to the rock formation in the bore hole. A bearing plate is retained on the rod threaded end portion. A nut engages the rod threaded end portion below the bearing plate. Stop means is positioned in the nut for obstructing axial movement of the nut beyond a first position on the rod threaded end portion to permit rotation of the nut and the rod as a unit in a preselected direction. Means is provided for restraining the means for mechanically anchoring the rod until the chemical anchor material is mixed by unitary rotation of the nut and the rod. The means for mechanically anchoring the rod is engageable with the wall of the bore hole upon continued rotation of the nut and the rod in said preselected direction after mixing of the chemical anchor material to anchor the rod in a fixed position in the bore hole. The stop means is displaced from a position in the nut obstructing axial movement of the nut on the rod threaded end portion where a predetermined torque is exceeded upon continued rotation of the nut in said preselected direction. The nut is rotatable relative to the rod upon displacement of the stop means to advance to a second position on the rod threaded end portion to urge the bearing plate into engagement with the rock formation and put the rod under tension.

Additionally in accordance with the present invention, there is provided a method for anchoring a rod in a bore hole of a rock formation that includes the steps of positioning an expansion shell having a plurality of longitudinally extending fingers in surrounding relation with an internally threaded camming plug. The camming plug is threadedly engaged with the expansion shell mounted thereon to an upper threaded portion of an elongated rod. The rod is advanced with the camming plug threadedly engaged thereto into a bore hole of a rock formation. A bearing plate is positioned on a lower threaded portion of the rod adjacent the rock formation externally of the bore hole. A nut is advanced on the rod lower threaded portion to a first position where axial movement of the nut on the rod is obstructed to permit rotation in a preselected direction of the nut and the rod as a unit. The nut and rod are rotated together in said preselected direction while maintaining the camming plug in fixed relation with the expansion shell. Continued rotation of the nut and rod in the same preselected direction moves the camming plug relative to the expansion shell to expand the fingers of the expansion shell and anchor the rod in the bore hole. Thereafter, the nut is rotated in said preselected direction relative to the anchored rod to advance the nut to a second position on the rod lower threaded portion to urge the bearing plate into engagement with the rock formation and put the rod under tension on the bolt.

Accordingly, the principal object of the present invention is to provide method and apparatus for supporting a rock formation by combined mechanical and chemical anchoring of a rod in a bore hole of the rock formation.

Another object of the present invention is to provide method and apparatus for combining chemical bonding and mechanical anchoring of a rod in a rock formation in which a resin cartridge system is utilized to chemically anchor the upper end portion of the rod in the bore hole which is initially anchored by an expansion shell assembly prior to setting of the mixed resin, and a threaded nut is advanced on the end of the rod emerging from the bore hole after expanding the shell and mixing the resin components to put the rod under tension.

A further object of the present invention is to provide a combination mechanical and point anchor resin roof bolt for supporting a mine roof by first positioning an expansion shell assembly on the bolt in a drilled bore hole to mix a multicomponent resin or grout system by continuous rotation of the bolt and then expanding the shell to anchor the bolt, followed by tightening a threaded nut on the end of the bolt emerging from the bolt hole to put the rod under tension.

An additional object of the present invention is to provide a method and apparatus that utilizes a mechanical anchor to mix the components of a quick setting resin system and provide mechanical anchoring of the rod in the bore hole and put the rod under tension by continuous rotation of the rod without interruption to permit curing of the mixed resin before the rod is tensioned.

Another object of the present invention is to provide a point anchor resin roof which utilizes a mechanical anchor to effect mixing of the components of a resin system in a drilled bore hole before the mechanical anchor is set followed by setting the mechanical anchor upon continuous rotation of the bolt in a single direction without interrupting rotation of the bolt to allow the resin to cure before the bolt is placed under tension.

These and other objects of the present invention will be more completely disclosed and described in the following specification,the accompanying drawings, and the appended claims.

DESCRIPTION OF THE PREFERRED EMBODIMENTS

Figure 1:
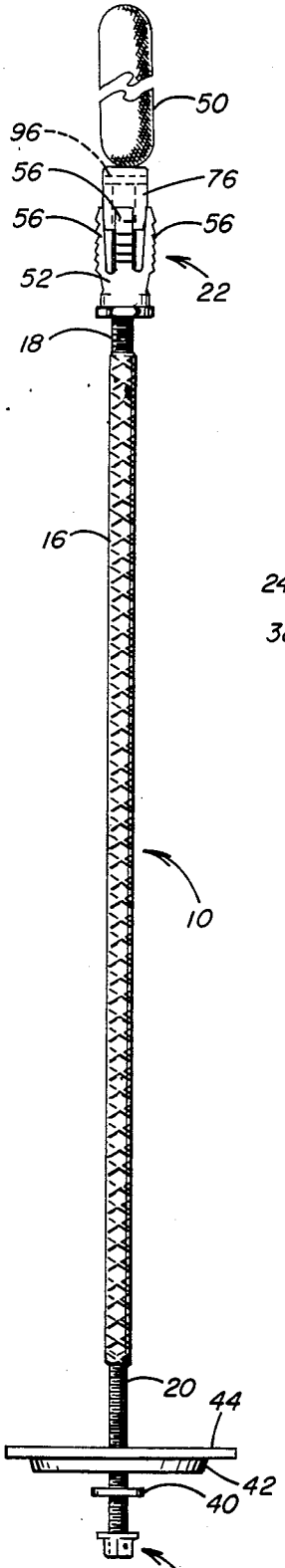
FIG. 1 is a view in side elevation of a roof bolt unit, illustrating an expansion shell assembly positioned on the upper threaded end of a reinforcing rod and a roof plate and shearable nut on a lower threaded end portion of the reinforcing rod.
Figure 2:
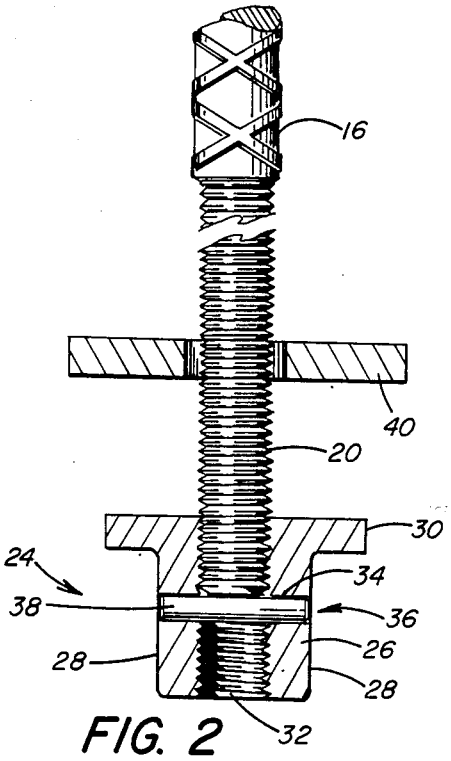
FIG. 2 is an enlarged fragmentary view, partially in section, of the lower threaded end portion of the reinforcing rod, illustrating a washer above a nut which is initially restrained by a stop device from rotating beyond a preselected point on the threaded end.
Figure 3:
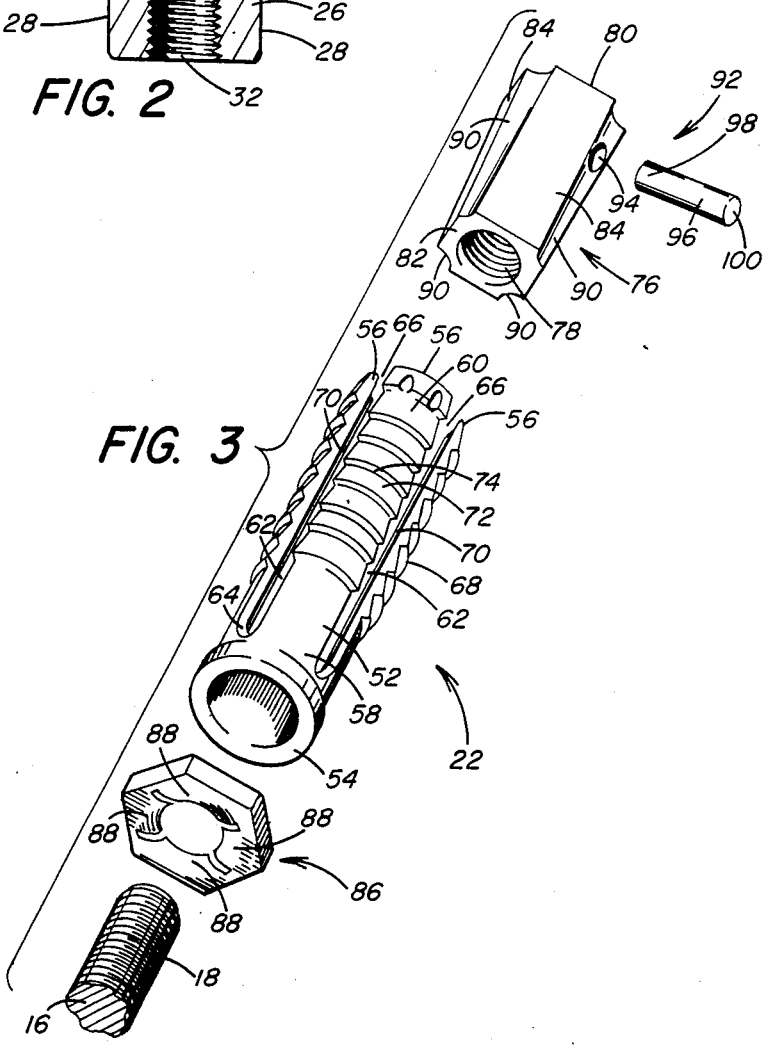
FIG. 3 is a fragmentary exploded view of the expansion shell assembly which is threaded onto the upper end of the reinforcing rod, illustrating a shearable pin that is carried by a camming plug to extend transversely through the plug for initially obstructing advancement of the end of the rod in the camming plug.
Figures 4, 5, 6:
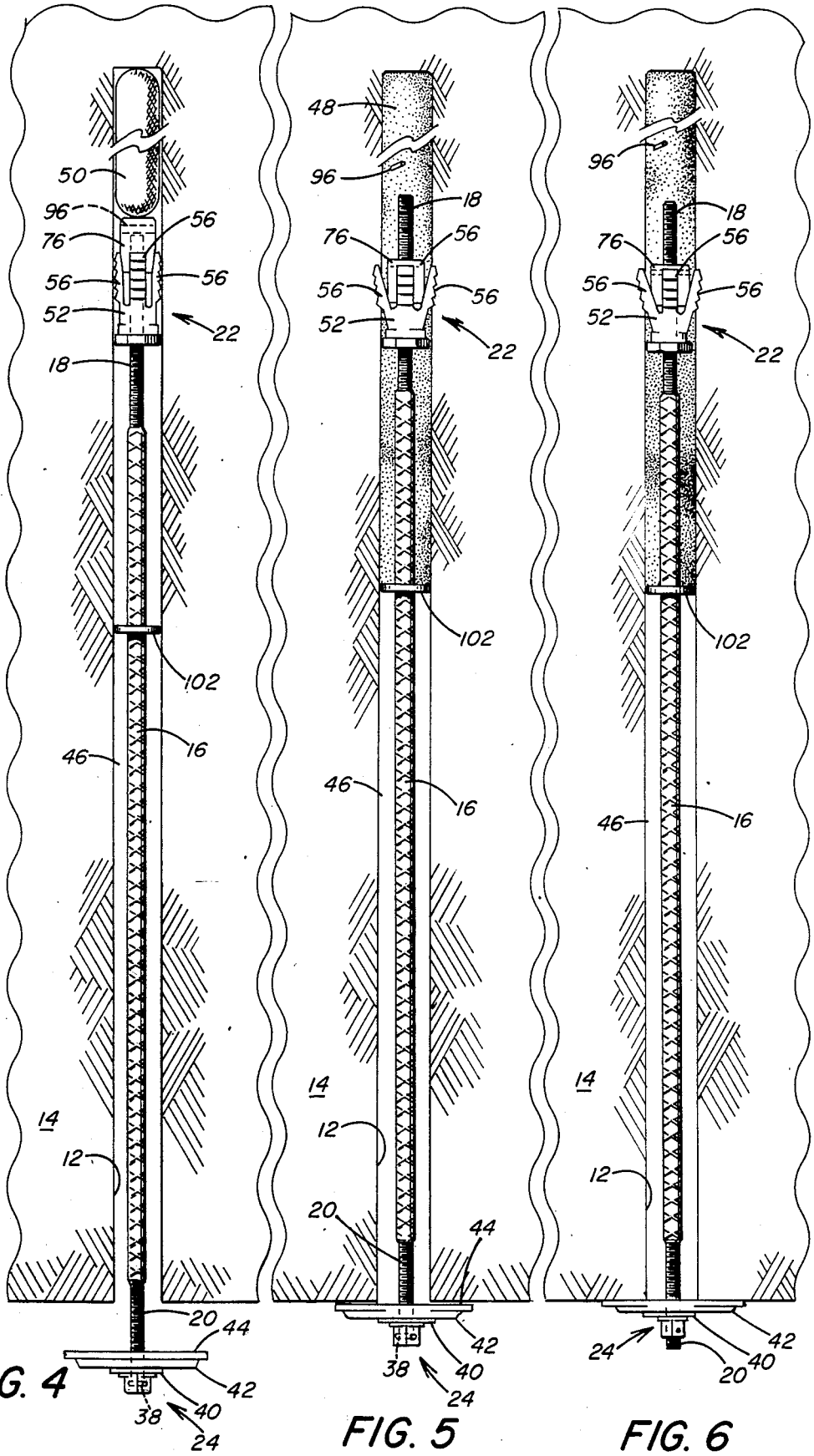
FIG. 4 is a view in side elevation, partially in section, of the first step in the method of installing the roof bolt unit in the bore hole, illustrating a resin cartridge advanced to the end of the bore hole for rupture by the expansion assembly.
FIG. 5 is a view similar to FIG. 4, illustrating the step of mixing the components of the ruptured cartridge by rotation of the rod and thereafter expanding the shell member in the bore hole.
FIG. 6 is a view similar to FIGS. 4 and 5, illustrating the step of tightening the nut on the lower threaded end portion of the rod to further tension the rod after mixing the resin components and expansion of the shell.

Referring to the drawings and particularly to FIGS. 1–3, there is illustrated a roof bolt unit generally designated by the numeral 10 for insertion in a bore hole 12 of a rock formation 14, in a manner shown in FIGS. 4–6, to support the rock formation 14. The rock formation 14 can include, for example, a mine roof that overlies a mine passageway or shaft, a subway tunnel or other similar subterranean structure. Preferably, the roof bolt unit 10 includes a reinforcing rod 16 of a preselected diameter, for example, $\frac{3}{4}$ inch or $\frac{7}{8}$ inch. A J-bar can also be used in place of the reinforcing rod 16. Both the J-bar or reinforcing rod 16 have a first or upper threaded end portion 18 and a second or lower threaded end portion 20. The length of the respective threaded portions 18 and 20 is selective and, in one embodiment, the length of the threaded upper end portion 18 is $4\frac{1}{2}$ inches, with the lower end portion 20 threaded an equal length or less as desired. An expansion shell assembly generally designated by the numeral 22 is positioned on the rod threaded end portion 18 and is advanced to the upper end portion of the bore hole 12 which is drilled to a preselected depth into the rock formation 14 as determined by the load bearing properties to be provided by the installed roof bolt 10.

As seen in greater detail in FIG. 2, a nut generally designated by the numeral 24 is threaded onto the rod lower threaded end portion 20. The nut 24 includes a body portion 26 having a preselected number of planar faces 28 and an upper circular flange portion 30 which is formed integral with the body portion 26. A threaded bore 32 extends through the nut body portion 26 and is engageable with the threaded end portion of the rod 16. A cylindrical bore 34 extends transversely through the nut body portion 26 and intersects the threaded bore 32 intermittently of the bore 32; however, the cylindrical bore can be located at any desired point to extend through the nut body portion 26 below the flange portion 30.

A stop member generally designated by the numeral 36, such as a shear pin 38, is retained in the transverse bore 34. With this arrangement, the nut 24 is advanced on the rod threaded end portion 20 until the extreme end of the rod 16 abuts the shear pin 38. At this point, further axial advancement of the nut 24 on the rod threaded end portion 20 is obstructed so that upon continued rotation of the nut 24, the rod 20 rotates with the nut 24. Also positioned on the rod threaded end portion 20 above the nut 24 is a circular hardened washer 40. As shown in FIGS. 1 and 4–7, the nut 24 and the washer 40 retain a roof plate 42 on the rod threaded end portion 20. The roof plate 42 includes a bearing surface 44 adapted to engage the surface of the rock formation 14 at the open end of the bore hole 12 as shown in FIGS. 4–6 to support the portion of the rock formation 14 surrounding the open end of the bore hole 12 to prevent degradation of the solid material surrounding the bore hole 12. The roof plate 42 is not shown in FIG. 2 for clarity of illustration of the nut 24 and washer 40 on the rod lower threaded end portion20.

The reinforcing rod 16 has a diameter which is less than the diameter of the bore hole 12 forming an annulus 46, as shown in FIGS. 4–6, therebetween. The annulus 46 in the area around the rod upper threaded end portion 18 and the expansion shell assembly 22 is filled with a resin or grout mixture 48, as shown in FIGS. 5 and 6, which is mixed by rotation of the expansion shell assembly 22 with the rod 16. The resin mixture 48 is formed from a multicomponent chemical system which is well known in the art and includes one or more fragmentable cartridges 50, as shown in FIGS. 1 and 4. In a well known arrangement, each cartridge 50 includes a polymerizable resin component separated from an initiator component or catalyst. When the cartridge 50 is broken and the roof bolt unit 10 is rotated, the components are mixed together to form a curable resin mixture or grout which hardens resulting in chemical anchoring of the rod 16 to the rock formation 14 surrounding the bore hole 12. Known chemical anchor systems, both quick-setting and fast-setting, adaptable for use with the present invention are disclosed in U.S. Pat. Nos. 3,324,661; 3,925,996 and 4,216,180.

The expansion shell assembly 22, which is positioned on the upper threaded end portion 18 of the rod 16, includes a shell member 52 having a ring end portion 54. A plurality of longitudinally extending fingers 56 extend axially from the ring end portion 54. Each finger 56 has lower end portion 58 connected to the ring end portion and an upper end portion 60. Longitudinal slots 62 divide the fingers 56 one from another. Each slot 62 has a closed end portion 64 adjacent the ring end portion 54 and an open end portion 66 adjacent the upper end portion 60 of each finger 56.

Further, each finger 56 includes an outer gripping surface 68 and an inner smooth surface 70. The outer gripping surface 68 includes a gripping portion 72 that extends from the finger upper end portion 60 to a position spaced from the finger lower end portion 58. The gripping portion 72 of each finger 56 includes a series of spaced, parallel, tapered, horizontal grooves 74. The grooves 74 form a series of downwardly extending serrations that are operable, upon expansion of the shell member 52 to engage the wall of the bore hole 12 as the fingers 56 bend outwardly.

The gripping portion 72 of each finger 56 is urged into contact with a wall of the bore hole 12, as seen in FIGS. 5 and 6, by a camming plug or wedge generally designated by the numeral 76 in FIG. 3. The camming plug 76 includes a threaded axial bore 78 for receiving the rod threaded end portion 18. The camming plug 76 has a tapered configuration with an enlarged upper end portion 80 and a reduced lower end portion82. A portion of the inner surface 70 of each finger 56 abuts a tapered planar surface 84 of the camming plug.

The shell member 52 is maintained in surrounding relationwith the camming plug 76 in a preselected position on the rod threaded end portion 18 by a nut generally designated by the numeral 86 in FIG. 3. The nut 86 is commercially available under the trademark "PAL-NUT" and includes thread engaging portions 88 which permit the nut 86 to be threaded onto the rod upper threaded end portion 18. The nut 86 is threaded to a preselected positionon the rod threaded end portion 18. The shell member 52 and the camming plug 76 are advanced to a position on the rod threaded end portion 18 to where the shell ring end portion 54 abuts against the nut 86. In this manner, the shell member 52 is retained in a preselected axial position on the rod threaded end portion 18.

As illustrated in detail in FIG. 3, the camming plug 76 includes a plurality of longitudinally extending grooves 90 separating the planar surfaces 84. The camming plug 76 includes a stop device generally designated by the numeral 92 in the form of a bore 94 that extends through the camming plug 76 transversely relative to the threaded bore 78. The ends of the transverse bore 94 emerge through a pair of oppositely aligned grooves 90 of the plug 76. A shearable pin 96 fabricated of a preselected yieldable material is positioned in the transverse bore 94. The pin 96 includes opposite end portions 98 and 100 which are retained in the transverse bore 94.

The shearable pin 96 extends transversely through the plug threaded bore 78 as shown in FIG. 1 to initially obstruct or prevent axial movement of the camming plug 76 beyond a preselected point on the rod upper threaded end portion18. Thus, upon initial assembly of the expansion shell assembly 22, the rod upper threaded end portion 18 is advanced into the camming plug 76 until the rod threaded end portion 18 abuts the shearable pin 96 and can advance no further into the camming plug threaded bore 78.

The location of the transverse bore 94 of the camming plug 76 is selective along the length of the camming plug, i.e. the bore 94 can be positioned adjacent the plug upper end portion 80, as shown in FIG. 3, or at a location adjacent the plug lower end portion 82. In the alternative,t he shearable pin 96 can be removed from the camming plug 76 and be retained in a transverse bore (not shown) through the rod threaded end portion 18 where the pin end portions 98 and 100 extend outwardly from the rod end portion 18. With this arrangement, the camming plug 76 is advanced downwardly on the rod threaded end portion 18 until the lower end portion 82 of the camming plug 76 abuts the pin end portions 98 and 100. In this position, the camming plug 76 is prevented from further downward movement on the rod threaded end portion 18.

The shearable pin 96 is fabricated of a selected material which can include wood, emtal, plastic or any other material which is operable to restrain relative movement between the camming plug 76 and the rod threaded end portion 18. It is the feature of the shearable pin 96 which restrains the shell member 52 from expanding into engagement with the wall of the bore hole 12 until the multicomponent resin system or grout 48 is mixed in the bore hole.

The type of material and the dimensions and particularly the cross sectional area of the pin 96 is selective to control the shearing of the pin based upon the type of bonding material, either resin or grout, utilized and the period of time required for mixing of the chemical components. As discussed above, both quick-setting and slow-setting resin systems are available. The type of system utilized will determine the shear characteristics of the pin 96.

Thus, for a quick-setting resin, the pin 96 will shear after relatively few rotations of the rod 16. On the other hand, when a slow-setting resin system is utilized, more revolutions of the rod 16 are required for thorough mixing of the chemical components before the pin 96 shears and the shell member 52 expands. It also should be understood that the stop device 92 can include any element positioned at a preselected location in the camming bore 78 obstructing advancement of the camming plug 76 beyond a preselected point on the rod threaded end portion 18. The stop device 92 fractures, yields or breaks away when the mixed chemical components of the resin or grout system being to harden and apply a force upon the expansion shell assembly 22 resisting rotation of the shell member 52 and the plug 76.

The stop device 92 is operable to fracture when the torque applied to the rod 16 exceeds a preselected torque. When the stop device 92 is no longer capable of resisting the anti-rotational forces of the mixed resin applied to the rotating expansion shell assembly 22, the stop device 92 is no longer operable to retain the shell fingers in an unexpanded condition. Relative rotation between the camming plug 76 and the rod 16 is no longer prevented. The camming plug 76 is free to move downwardly on the rod threaded end portion 18 as the rod 16 continues to rotate in the same preselected direction.

The stop device 92 in the form of the shearable pin 96 is operable for use with a wide variety of multicomponent resin or grout systems. The shearable pin 96 is selected from a material having a preselected cross sectional area, and the pin 96 is positioned at a preselected location relative to the camming plug 76 to restrain expansion of the shell member 52 until the required mixing of the chemical components has been completed and a predetermiend torque has been applied to the rod 16. Depending upon the characteristics of the chemical anchor used, the characteristics of the stop device 2 can be selected to accommodate a quick-setting resin that begins to cure within 5 seconds of mixing or a slow-resin that begins to cure within 2 to 3 minutes of mixing.

Thus the stop device 92 can embody any type of obstruction positioned in the bore 78 of the camming plug or associated with the rod threaded end portion 18 and the camming plug 76. In both cases the stop device 92 is operable to restrain relative rotation between the camming plug 76 and the rod 16 until a predetermined torque is applied to the rod 16. A stop device 92 can also include, for exmaple, a plastic disc (not shown) selectively positioned in the camming plug bore 78 and operable to initially restrain relative movement between the camming plug 76 and the rod 16 until a predetermined torque has been applied to the rod 16. When the torque applied to the rod 16 exceeds a preset amount, the plastic disc shears or fractures to permit the shell member 52 to expand by movement of the camming plug 76 on the rod threaded end portion 18.

The stop device 92 can also embody a wire having end portions secured to the camming plug 76 and extending through the plug threaded bore 78, obstructing the path of the rod 16. It should be understood that the stop device can include further embodiments which function to restrain movement of the camming plug 76 relative to the rod 16 until the anti-rotational forces of the mixed resin or grout 40 applied to the camming plug 76 result in fracture or yielding of the stop device 92. Upon fracture or yielding of the stop device 92, downward movement of the camming plug 76 is permitted on the rod threaded end portion 18 upon continued rotation of the rod 16.

Once the mixed resin has begun to cure and to exert anti-rotation forces upon the camming plug 76, the stop device 92, for example the shearable pin 96, is no longer capable of resisting these forces. The stop devices 92 shears or yield, thereby freeing the rod 16 to rotate relative to the camming plug 76. Consequently, the camming plug 76 moves downward on the rod threaded end portion 18 to expand the fingers 56 of the shell member 52 into engagement with the wall of the bore hole 12. This operation is carried out by continous rotation of the rod 16 in a single preselected direction. Preferably, the stop device 92 yields before the mixed resin completely solidified or hardens so that the expanded fingers 56 are movable outwardly into gripping engagement with the wall of the bore hole.

As shown in FIG. 4, the rod 16 with the expansion shell assembly 22 positioned on the rod threaded end portion 18 and the roof plate 42 and nut 24 positioned on the rod threaded end portion 20 are advanced upwardly behind one or more cartridges 50 of a multicomponent resin system into the bore hole 12. The cartirdges 50 are pushed to the blind or closed end of the bore hole 12. As the roof bolt unti 10 is rotated and thrust upwardly into the bore hole, the rod upper end portion 18 passes through the cartridges 50 to rupture the cartridges 50 and release the chemical components. The roof bolt 10 is continuously rotated in a preselected direction by applying a torque to the nut 24 on the rod lower threaded end portion 20.

In this manner the components are mixed to form the curable mixture 48. With the nut 24 advanced on the rod threaded end portion 20 in the point where the shear pin 38 in the nut 24 abuts the extreme end of the rod 16, the rod 16 rotates with the nut 24. Similarly, the stop device 92 associated with the expansion shell assembly 22 maintains the shell member fingers 56 in an unexpanded condition. Thus, as the roof bolt unit 10 is rotated to effect mixing to the chemical components, the camming plug 76 is initially restrained during the mixing stage from moving downwardly on the rod 12 by the rod upper threaded end portion 18 abutting the stop device 92, for example the shearable pin 96.

Rotation of the rod 16 effects mixing of the resin components, and as the rod 16 is rotated, the resin components form the curable resin mixture 48, as seen in FIG. 5. The mixed resin flows downwardly into surrounding relation with the expansion shell assembly 22 before it is expanded. The number of resin cartridges utilized and the amount of curable resin to be mixed in the bore hole 12 around the roof bolt 10 is selective. Thus by using a plurality of cartridges 50, a substantial volume of mixed resin is positioned in the annulus 46 around the rod 16 along a substantial length of the rod and particularly below the expansion shell assembly 22. Thus the mixed resin 48 is permitted to flow downwardly past the expansion shell assembly 22 by virtue of clearance provided betweenthe nut 86 and the bore hole wall.

To effectively retain the resin mixture 48 in surrounding relatio with a selected length of the rod 16, a suitable device, such as a washer 102, is retained on the rod 16 a preselected distance below the expansion shell assembly. In one embodiment the washer 102 can be a metal washer either welded or press fit on the rod 16. In another embodiment the washer 102 can be fabricated of an elastomeric material. In both embodiments the washer 102 is fixedly retained on the rod 16 to prevent the resin mixture 48 from flowing beyond a certain point in the bore hole 12. In this manner the length of the cured resin column around the rod 16 is controlled. It should be understood that the washer 102 while preventing the resin mixture 48 from flowing beyond a certain point in the bore hole 12 does not obstruct or interfere with the upward installation of the roof bolt unit 10 in the rock formation 14.

The expansion shell member 52 is maintained in an unexpanded condition until the chemical components are completely mixed. Depending upon the setting characteristics of the multicomponent resin system or grout, i.e. either a quick-setting system or a slow-setting system, mixing of the chemical components is completed with relatively few revolutions of the rod 16. For example, the resin components for a quick-setting resin system can be completely mixed after rotation of the unexpanded shell member 52 for a period of time of 2 to 5 seconds. On the other hand, for a slow-setting resin systems, rotation of the unexpanded shell member 52 continues for a period of time of 20 to 30 seconds. During the mixing stage, the roof plate 42 is held in contact with the rock formation 14 around the open end of the bore hole 12.

Once mixing of the resin components is complete, the resin mixture flows into the fissures and faults of the rock formation surrounding the bore hole. In this well known manner, the layers of the rock strata are adhesively united to further reinforce the rock formation. After the mixing stage the resin mixture 48 cures and begins to harden in the bore hole 12. As the mixture 48 begins to harden, the shell member 52 and the camming plug 76 encounter resistance to rotation. Thus at a predetermined torque applied to the rod 16 after mixing of the resin components, the material strength of the stop device 92 in the camming plug 76 is exceeded by the anti-rotational forces applied thereto by the resin mixture 48. Consequently, the stop device 92, such as the shear pin 96, breaks or fractures thereby releasing the camming plug 76 to move relative to the rod 16 to expand the fingers 56 of the shell member 52 into engagement with the wall of the bore hole.

The rod 16 by applying torque to the nut 24 is rotated in a single continuous direction to effect both mixing of the resin components and expansion of the shell member 52. In accordance with the present invention, there is no interruption in the rotation of the rod 16 between the mixing of the resin components and the expansion of the shell member 52.

As illustrated in FIG. 5, after the resin mixture 48 has cured and sufficiently hardened to break the shearable pin 96, the camming plug 76 moves downwardly on the rod threaded end portion 18. Downward movement of the plug 76 bends the shell fingers 56 outwardly about the shell ring end portion 54 to move the outer gripping surfaces 68 into gripping engagement with the wall of the bore hole 12. Rotation of the rod 16 continues until a preselected torque is applied to the rod 16, at which point the shell member 52 is fully expanded and the gripping portions 72 of the finger outer gripping surfaces 68 are embedded in the rock formation to securely anchor the rod 16 in the bore hole 12, as illustrated in FIG. 6. Expansion of the shell member 52 into engagement with the rock formation 14 also puts the rod 16 under tension.

The addition of the cured resin mixture 48 in surrounding relation with the rod 16 and the expanded shell member 52 prevents slippage of the expanded shell 52 in the bore hole 12. In this manner tension on the rod 16 is maintained. The tension is not reduced by slippage of the expanded shell member 52 in the bore hole 12 as a result of deterioration of the rock formation 14 surrounding the bore hole 12 and a reduction in the contact area between the expanded shell 52 and the wall of the bore hole. It is well known that in soft rock conditions, deterioration of the surrounding rock formations, particularly due to exposure to air and moisture, causes a mechanical anchor to slip and the bolt tension to decrease substantially.

The chemical anchor formed by the resin mixture 48 is resistant to deterioration of the surrounding rock formation around the bore hole because the chemical anchor adhesively unites the layers of the rock strata and substantially prevents deterioration of the rock formation immediately around the bolt hole. Also the provision of a chemical anchor serves to seal the expansion shell assembly 22 from the effects of air and moisture. Thus the expansion shell assembly 22, as well as the rod 16 in the area of the expansion shell assembly 22, are protected against the effects of deterioration caused by rust due to metal-rock contact.

As shown in FIG. 5, during the mixing stage when he fingers 56 of the shell member 52 are maintained in an unexpanded condition and after the mixing when the shell fingers 56 are expanded into gripping engagement with the wall of the bore hole, the nut 24 on the rod lower end portion 20 rotates with the rod 16. However, once the resin components are mixed and the shell member 52 has expanded, the rod 16 is placed in tension. Also at this point in the assembly of the roof bolt unit 10, the bearing surface 44 of the roof plate 42 is in compressive relation with the face of the rock formation 14 surrounding the opening into the bore hole 12.

Upon continued rotation of the rod 16 in the same direction, after the rod 16 is anchored by expansion of the shell member 52 and the resin mixture 48 is formed, application of a predetermined torque to the nut 24 shears or fractures the stop member 36, such as the shear pin 38. Once the shear pin 38 is broken within the threaded bore 32 of the nut 24, the nut 24 no longer encounters resistance to rotation on the rod threaded end portion 20. Accordingly, continued rotation of the nut 24 advances the nut upwardly on the rod threaded end portion 20 into contact with the roof plate 42.

Continued rotation of the nut 24 urges the nut flange 30 and the hardened washer 40 into compressive relation with the roof plate 42. As a result, the plate bearing surface 44 is further compressed into contact with the face of the rock formation 14 around the bore hole 16. A predetermined torque is applied to the nut 24 to put the rod 16 under the desired tension. With the rod 16 under tension, the layers of the rock strata are reinforced to resist the vibrations and shock waves that tend to shear apart the overlying layers of the rock strata.

Mechanically interlocking the rock strata by penetration of the resin mixture 48 into the rock fissures and tensioning the rod 16 which is both chemically and mechanically anchored within the bore hole provides a roof support system that utilizes the advantages of both mechanical and chemical anchoring. By combining the advantages of mechanical and chemical anchoring the roof bolt 10 is installed under tension to provide improved reinforcement of the rock strata which is not available by chemical anchoring alone.

With the present invention the rod 16 is fully tensioned prior to complete curing of the resin mixture 48. As a result, the roof bolt unit 10 is installed by continuous rotation of the rod 16 in a single direction. A change in the direction of rotation of the rod 16 is not required. Interruption of rotation of the rod 16 is not required to permit the resin mixture 48 to cure before the rod 16 is placed under the desired tension. The expansion of the shell member 52 tensions the bolt 16 immediately after mixing of the resin components. After the resin mixture 48 has been formed, the rod 16 is further tensioned by tightening the nut 24 on the rod lower end portion 20. By utilizing the stop device 92 associated with the expansion shell assembly 22 and the stop member 36 associated with the nut 24, complete mixing of the resin components is assured before the rod 16 tensioned, and the rod 16 is placed under tension without interrupting rotation of the rod to permit the resin mixture 48 to cure.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for supporting a rock formation comprising, an elongated rod positioned in a bore hole of a rock formation, said rod having a first threaded end portion and a second threaded end portion, said rod first threaded end portion being positioned adjacent the end of the bore hole, said rod second threaded end portion extending out of the bore hole, an expansion shell assembly engaged to said rod first threaded end portion, a bearing plate positioned on said rod second threaded end portion, a nut engaging said rod second threaded end portion below said bearing plate, stop means for abstructing axial movement of said nut beyond a first position on said rod second threaded end portion to permit said initial rotation in said preselected direction of said nut and said rod as a unit, said expansionshell assembly operable upon rotation of said rod in said bore hole to anchor said rod in a fixed position in said bore hole, said stop means being operable to permit axial movement of said nut on said rod second threaded end portion when a predetermined torque is exceeded during said continued rotation of said nut and said rod in said preselected direction, and said nut being rotatable relative to said rod and operable to advance during further rotation of said nut in said preselected direction to a second position on said rod second threaded end portion to urge said bearing plate against said rock formation and tension said rod.

2. Apparatus for supporting a rock formation comprising, an elongated rod positioned in a bore hole of a rock formation, said rod having a first threaded end portion and a second threaded end portion, said rod first threaded end portion being positioned adjacentthee end of the bore hole, said rod second threaded end portion extending out of the bore hole, a camping plug threadedly engaged to said rod first threaded end portion for axial movement thereon, an expandable shell having a plurality of longitudinally extending fingers spaced from one another, said fingers each having an inner surface and an outer surface, a portion of said inner surface abutting said camming plug and said outer surface adapted to engage the wall of the bore hole, means for preventing axial movement of said camming plug relative to said expandable shell upon initial rotation of said rod in a preselected direction, a bearing plate positioned on said rod second threaded end portion, a nut engaging said rod second threaded end portion below said bearing plate, stop means for obstructing axial movement of said nut beyond a first position on said rod second threaded end portion to permit said intial rotaion in said preselected direction of said nut and said rod as a unit, said camming plug being movable relative to said expandable shell during said continued rotation of said rod to expand said fingers to anchor said rod in a fixed position in the bore hole, said stop means being operable to permit axial movement of said nut on said rod second threaded end portion when a predetermined torque is exceeded during said continued rotation of said nut and said rod in said preselected direction, and said nut being rotatable relative to said rod and operable to advance during further rotation of said nut in said preselected direction to a second position on said rod second threaded end portion to urge said bearing plate against said rock formation and tension said rod.

3. The apparatus as set forth in claim 2, wherein said means for preventing axial movement of said camming plug relative to said expandable shell includes displaceable means between said camming plug and said rod first threaded end portion.

4. The apparatus set forth in claim 3, wherein said continued rotation in said preselected direction of said nut and said rod as a unit produces a predetermined relative torque between said rod and said camming plug and said predetermined relative torque displaces said displaceable means.

5. The apparatus set forth in claim 4, wherein said first threaded end portion of said rod with said expandable shell and camming plug thereon is adapted to extend into a chemical anchor material in said bore hole and to mix at least a portion of said chemical anchor material during said initial rotation.

6. A combination mechanical anchor and chemical anchor system for supporting a rock formation comprising, chemical anchor material positioned in a bore hole of a rock formation, an elongated rod positioned in the bore hole, said rod having one end portion positioned adjacent said chemical anchor material and an opposite threaded end portion extending out of the bore hole, means for mechanically anchoring said rod one end portion to the rock formation in the bore hole, a bearing plate retained on said rod threaded end portion, a nut engaging said rod threaded end portion below said bearing plate, displaceable means between said nut and said rod threaded end portion for obstructing axial movement of said nut beyond a first position on said rod threaded end portion to permit initial rotation of said nut and said rod as a unit in a preselected direction, said means for mechanically anchoring said rod being engageable with the wall of the bore hole upon continued rotation of said nut and said rod in said preselected direction after mixing at least a portion of said chemical anchor material to anchor said rod in a fixed position in said bore hole, said displaceable means being displaced from a position obstructing axial movement of said nut on said rod threaded end portion when a predetermined torque is exceeded during said continued rotation of said nut in a preselected direction, and said nut being rotatable relative to said rod upon displacement of said displaceable means to advance during further rotation of said nut in said preselected direction to a second position on said rod threaded end portion to urge said bearing plate against the rock formation and tension said rod, 7. A combination mechanical anchor and chemical anchor system for supporting a rock formation as set forth in claim 6 which includes, means for restraining said means for mechanically anchoring said rod until at least a portion of said chemical anchor material is mixed by unitary rotation of said nut and said rod.

8. A method of anchoring a rod in a bore hole of a rock formation comprising, positioning an expansion shell having a plurality of longitudinal extending fingers in surrounding relation with an internally threaded camming plug, threadedly engaging the camming plug with the expansion shell mounted thereon to an upper threaded portion of an elongated rod, advancing the rod with the camming plug threadedly engaged thereto into a bore hole of a rock formation, positioning a bearing palte on a lower threaded portion of the rod adjacent the rock formation externally of the bore hole, advancing a nut on the rod lower threaded portion to a first position where axial movement of said nut on said rod is obstructed to permit rotation in a preselected direction of said nut and said rod as a nut, rotating together the nut and the rod in said preselected direction while maintaining the camming plug in fixed relation with the expansion shell, continuing rotation of the nut and the rod in the same preselected direction to move the camming plug relative to the expansion shell to expand the fingers of the expansion shell and anchor the rod in the bore hole, and thereafter rotating the nut in said preselected direction relative to the anchored rod to advance the nut to a second position on the rod lower threaded portion to urge said bearing plate against the rock formation and tension said bolt.

9. A method of anchoring a rod in a bore hole of a rock formation comprising, positioning an expansion shell assembly including an expansion shell having a plurality of longitudinally extending fingers surrounding an internally threaded camming plug on an upper threaded end portion of a rod, threadedly engaging said camming plug with said expansion shell mounted thereon to said upper threaded end portion of said rod, positioning a bearing plate on a lower threaded portion of said rod, advancing a nut on said rod lower threaded end portion to a first position where axial movement of said nut on said rod is obstructed to permit rotation in a preselected direction of said nut and said rod as a unit, inserting at least one cartridge of chemical anchor material in said bore hole, thereafter inserting said rod with said expansion shell assembly theron into said bore hole and fracturing said cartridge of chemical anchor material with said bolt and expansion shell assembly.

rotating said nut and rod in said preselected direction to move said camming plug relative to said expansion shell to expand said expansion shell fingers and anchor said rod in said bore hole, and thereafter rotating said nut in said preselected direction relative to said rod to advance said nut to a second position on said rod lower threaded portion to urge said bearing plate against the rock formation and apply a tension to said bolt.

10. A method of anchoring a rod in a bore hole of a rock formation comprising, positioning an expansion shell assembly including an expansion shell having a plurality of longitudinally extending fingers surrounding an internally threaded camming plug on an upper threaded end portion of a rod, threadedly engaging said camming plug with said expansion shell mounted thereon to said upper threaded end portion of said rod, positioning a bearing plate on a lower threaded portion of said rod, advancing a nut on said rod lower threaded end portion to a first position where axial movement of said nut on said rod is obstructed to permit rotation in a preselected direction of said nut and said rod as a unit, inserting at least on cartridge of chemical anchor material in said bore hole, thereafter inserting said rod with said expansion shell assembly thereon into said bore hole and fracturing said cartridge with said bolt and expansion shell assembly, rotating said nut and rod in said preselected direction while maintaining said camming plug in fixed relation with said expansion shell while mixing at least a portion of said chemical anchor material in said bolt hole, thereafter further rotating said nut and rod in said preselected direction to move said camming plug relative to said expansion shell and expan said expansion shell fingers and anchor said rod in said bore hole, and thereafter rotating said nut in said preselected direction relative to said anchored rod to advance said nut to a second position on said rod lower threaded portion to urge said bearing plate against the rock formation in said bore hole and apply a tension to said bolt.

* * * * *